US005743306A

United States Patent [19]

Stewart et al.

[11] Patent Number: 5,743,306

[45] Date of Patent: Apr. 28, 1998

[54] APPARATUS AND METHOD FOR LOADING TUFTS INTO A TUFT CARRIER

[75] Inventors: Richard Donald Stewart, Co. Down; John Dalton Griffith, Sunderland, both of United Kingdom

[73] Assignee: Ulster Carpet Mills (Holdings) Limited, Craigavon, United Kingdom

[21] Appl. No.: 676,383

[22] PCT Filed: May 12, 1995

[86] PCT No.: PCT/GB95/01090

§ 371 Date: Jul. 22, 1996

§ 102(e) Date: Jul. 22, 1996

[87] PCT Pub. No.: WO95/31594

PCT Pub. Date: Nov. 23, 1995

[30] Foreign Application Priority Data

May 12, 1994 [GB] United Kingdom ..... 9409442

[51] Int. Cl.[6] ..... D03D 39/00

[52] U.S. Cl. ..... 139/7 A

[58] Field of Search ..... 139/7 A, 7 F, 7 D, 139/7 R

[56] References Cited

U.S. PATENT DOCUMENTS

| | | | |
|---|---|---|---|
| 3,387,577 | 6/1968 | Spanel et al. | 139/7 R |
| 3,415,209 | 12/1968 | Ellison et al. | 139/7 R |
| 3,807,459 | 4/1974 | Tolley | 139/7 D |
| 4,039,007 | 8/1977 | Coleman et al. | 139/7 F |

FOREIGN PATENT DOCUMENTS

| | | |
|---|---|---|
| 0 379 387 | 7/1990 | European Pat. Off. . |
| 600153 | 5/1925 | France . |
| 1 337 722 | 11/1973 | United Kingdom . |
| 2227499 | 8/1990 | United Kingdom . |

*Primary Examiner*—Andy Falik

*Attorney, Agent, or Firm*—Dann, Dorfman, Herrell and Skillman; Henry H. Skillman

[57] ABSTRACT

A tuft carrier loading apparatus for loading individual tufts into tuft-retention sites spaced along an elongate tuft carrier which is guided for longitudinal movement along a path of travel having a plurality of individually selectively operable tuft forming devices. Each tuft forming device is operable to feed an individual tuft to a tuft-retention site on the carrier. The carrier moves along said path of travel intermittently through a series of successive positions where predefined tuft retention sites are moved temporarily into registry with each tuft forming devices. By controlling selection of the tuft forming devices, tufts are fed to selected sites while the carrier is located at each successive position.

11 Claims, 8 Drawing Sheets

APPARATUS AND METHOD FOR LOADING TUFTS INTO A TUFT CARRIER

FIELD OF THE INVENTION

The present invention relates to an apparatus and method for loading tufts into a tuft carrier for use with a gripper loom, in particular but not exclusively, an Axminster gripper loom.

The present invention also relates to a loom incorporating the tuft loading apparatus and a method of weaving on a loom.

BACKGROUND OF THE INVENTION

Usually for the weaving of a Jacquard Axminster carpet, a large creel of bobbins is employed to provide the necessary number of colors and yarn ends for each tuft in the carpet. The large number is necessary to allow a complete row of tufts to be woven into the carpet simultaneously. For example, a typical 4 yard wide loom with a pitch of seven tufts per inch would weave 1008 tufts into the carpet across its width. An alternative method of yarn supply is used in the Spool Gripper loom, where a smaller number of bobbins are used to supply an off-line spool winding process. Each spool in the complete set has a pre-selected set of colors appropriate to a particular row in the carpet. The advantage of this method is that more yarn colors can be used but weaving on a spool loom consumes a greater quantity of yarn than on a gripper loom and therefore is more suitable to larger batch quantities. A further disadvantage is that the pattern repeat length is limited to the number of spools in the supply system.

Alternative systems to the creels or spools have been used but the large number of yarn sources are still created, along with the associated bulk, complexity and potential for waste. The ideal solution to the creation of woven patterned Axminster carpet would be to reduce the number of yarn sites required during all stages of the process and only create the full set of tufts just when they are required.

SUMMARY OF THE INVENTION

It is therefore a general aim of the present invention to provide an apparatus and method for providing rows of tufts for a gripper loom which may contain a wide variety of colors and yet which uses a small number of yarn sources.

According to one aspect of the present invention, there is provided a tuft carrier loading apparatus for loading individual tufts into tuft retention sites spaced along an elongate tuft carrier, the apparatus including:

guide means for guiding longitudinal movement of the tuft carrier along a path of travel, a plurality of individually selectively operable tuft forming means spaced along said path of travel, each tuft forming means being operable when selected to feed an individual tuft to a tuft retention site on said carrier, drive means drivingly connected to the carrier for moving the carrier along said path of travel, the drive means being operable to intermittently move the carrier through a series of successive positions whereat predefined tuft retention sites are moved temporarily into registry with each tuft forming means, and control means for controlling selection of the tuft forming means, the control means being operable to actuate selected tuft forming means to feed tufts to those sites in registry with the selected tuft forming means while the carrier is located at each successive position.

According to another aspect of the present invention, there is provided a method of loading an elongate tuft carrier with tufts, the elongate tuft carrier having a plurality of tuft retention sites spaced along its length, the method including guiding longitudinal movement of the tuft carrier along a path of travel, arranging a plurality of individually selectively operable tuft forming means in spaced relationship along said path of travel, driving the tuft carrier intermittently through a series of successive positions so that predefined tuft retention sites are moved into temporary registry with each tuft forming means and operating selected tuft forming means to feed a tuft into a site presented thereto while the carrier is located at each successive position.

The present invention involves a new way of pre-selecting the required number of yarns in a sequential manner, thus avoiding the need to have the large number of yarn sources present at one time.

The existing Gripper Axminster weaving process requires the need to simultaneously create a row of tufts for the complete width of carpet. This row of tufts is held in individual grippers which transport the cut lengths of yarn from the Jacquard or Spool source to the weaving position in the carpet.

The system according to the present invention involves creating a pre-selected row of tufts of yarn in a sequential manner. The size of the creel or yarn supply device required is dependent upon the relationship between the speed of the loom and the rate at which tufts can be created and stored. The faster the tuft forming means, the smaller the number of tufts need be created at once. For instance, if the tuft forming means operates at four times the speed of the loom, then the number of yarn ends from which tufts are produced need only be enough for a quarter of the width of the loom, ie. a four yard loom would have a 1 yard equivalent creel.

Higher weaving speeds can be achieved by operating the tuft forming process continuously, rather than intermittently, as at present in existing looms. In existing looms, a single set of grippers in an Axminster loom must grip a selected yarn from a yarn carrier, draw off the appropriate amount to form the pile, hold it while it is cut and then transport it into the carpet. By using a tuft carrier in accordance with the present invention, the grippers do not perform the tuft formation; this enables the tuft forming process to be performed continuously and independently of the grippers.

In this specification, the term 'yarn carrier' relates to the carrier which locates the yarn sources and is normally selected by a Jacquard system and the term 'tuft carrier' relates to the carrier which carries a single pre-selected row of tufts.

BRIEF DESCRIPTION OF THE DRAWINGS

Various aspects of the present invention are hereinafter described with reference to the accompanying drawings, in which.

DESCRIPTION OF THE PREFERRED EMBODIMENTS

Figure 3:
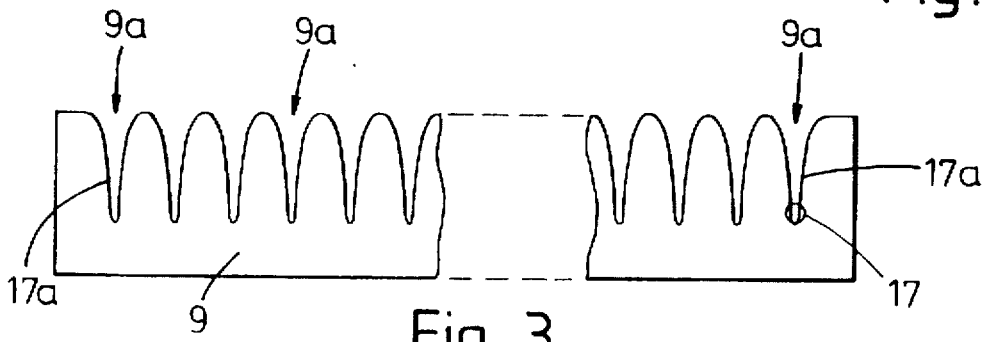
FIG. 3 is a plan view of a suitable tuft carrier for use in the present invention.
Figure 4:
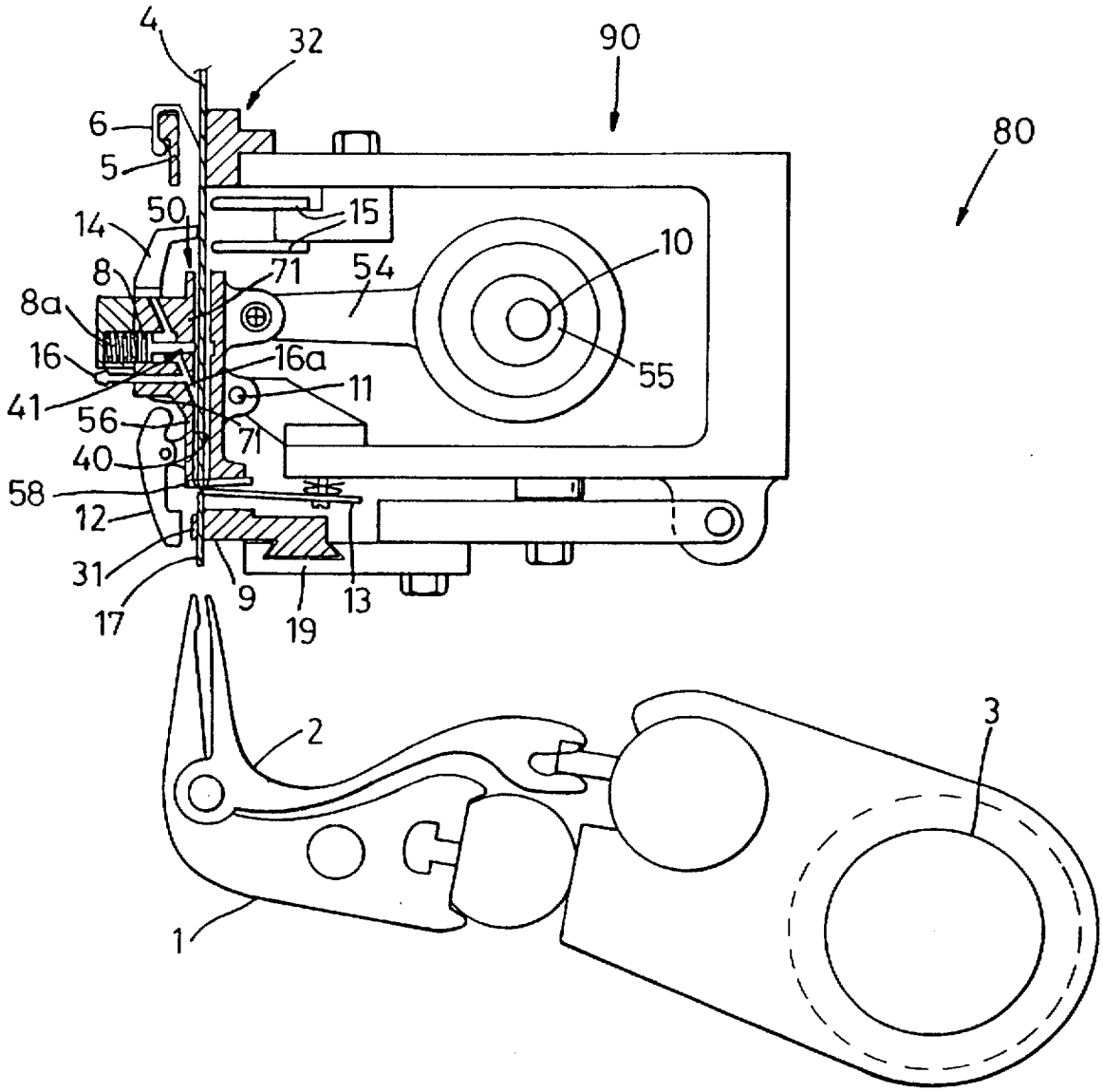
FIG. 4 is a part side view of a loom including tuft forming apparatus according to a first embodiment of the present invention.

The apparatus and method of the present invention uses an elongate tuft carrier 9 (FIG. 3) having a plurality of tuft retention sites 9a spaced along one side of the carrier. The sites are spaced apart by the same spacing as between the grippers 1 (FIG. 6) of the loom.

The carrier 9 is preferably rigid and is adapted to securely hold each tuft 17. This is preferably achieved by shaping the profile of each slot 17a defining a tuft retention site 9a such that the inherent elasticity of the yarn forming tuft 17 holds the tuft at the bottom of the slot 17a when pressed therein.

It is envisaged that alternate methods may be adopted for retaining the tuft 17. For example, the carrier 9 may be adapted such that at least one or both opposing sides of each slot 17a is formed of a resilient material capable of gripping a tuft presented into the slot; alternatively the sides of the slot 17a may be rigid and a resilient clip may be provided to hold the tuft in place.

Figure 1:
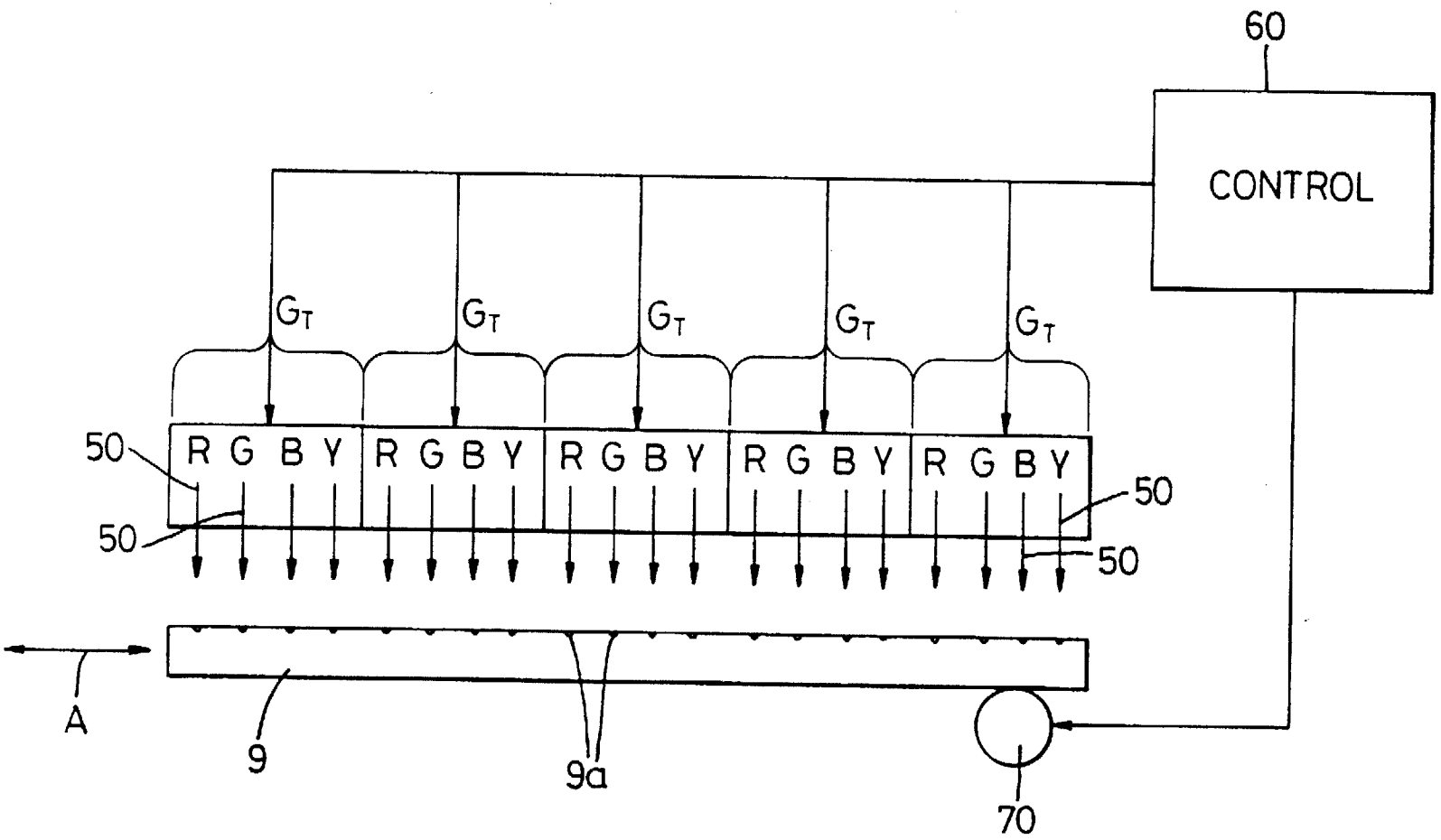
FIG. 1 is a schematic diagram of an apparatus according to one embodiment of the present invention.

Referring to FIG. 1, there is schematically illustrated an apparatus and method according to the present invention for loading tufts into the yarn carrier 9.

The yarn carrier 9 is guided for longitudinal movement (indicated by arrow A) along a path of travel determined by guide means (not shown).

A plurality of tuft forming means 50 are spaced along the path of travel, the spacing between adjacent tuft forming means 50 preferably being equal to the spacing between adjacent tuft retention sites 9a.

Each tuft forming means 50 is supplied with one yarn end and preferably the yarn ends are arranged such that adjacent tuft forming means 50 are supplied with a yarn possessing a different characteristic. Normally the characteristic will be color of the yarn but it may be other characteristics such as yarn weight, type or a combination of these characteristics.

In the example illustrated in FIG. 1, 4 different colored yarns are supplied to the tuft forming means; these are designated R, G, B, Y. The yarns are preferably arranged in a sequence which, as shown in FIG. 1, is repeated along the path of travel. The tuft forming means 50 are therefore divided into groups $G_T$ spaced along the path of travel, each group containing an identical sequence of yarns. Each tuft forming means 50 is individually selectable such that on selection it functions to supply a tuft of yarn to a site 9a presented thereto. If the tuft forming means 50 is not selected, then it does not supply a tuft to the site 9a presented thereto.

A control means 60 is provided which operates to control selection of each tuft forming means 50. Preferably the control means 60 is electronically operable to control the tuft forming means 50 and is programmable so as to enable different combinations of tufts to be loaded into the carrier 9 in response to a predetermined pattern.

The tuft carrier 9 is moved along the path of travel by a drive means 70 which operates to move the carrier 9 stepwise through a sequence of loading positions so as to temporarily present predefined sites to each tuft forming means 50.

In the example of FIG. 1, the carrier 9 is moved through a sequence of 4 steps by drive means 70 during the tuft carrier loading process. Preferably the drive means 70 operates under the control of the control means 60 such that the control means 60 selectively determines each loading position of the carrier 9 during the loading process. A suitable drive means 60 would comprise a stepper motor which drives the carrier through a suitable gear transmission.

It is envisaged that the carrier 9 may be driven through a set sequence of loading positions and that for such an arrangement a suitable cam drive or other similar fixed mechanical drive could be provided.

The tuft loading process will now be described with reference to FIGS. 1 and 2 wherein the number of tuft forming means 50 is the same as the number of sites 9a in the carrier 9. At the start of the loading process, the carrier 9 is located at a first loading position (as shown) whereat each tuft retention site 9a is in registry with a respective tuft forming means 50.

Figure 2:
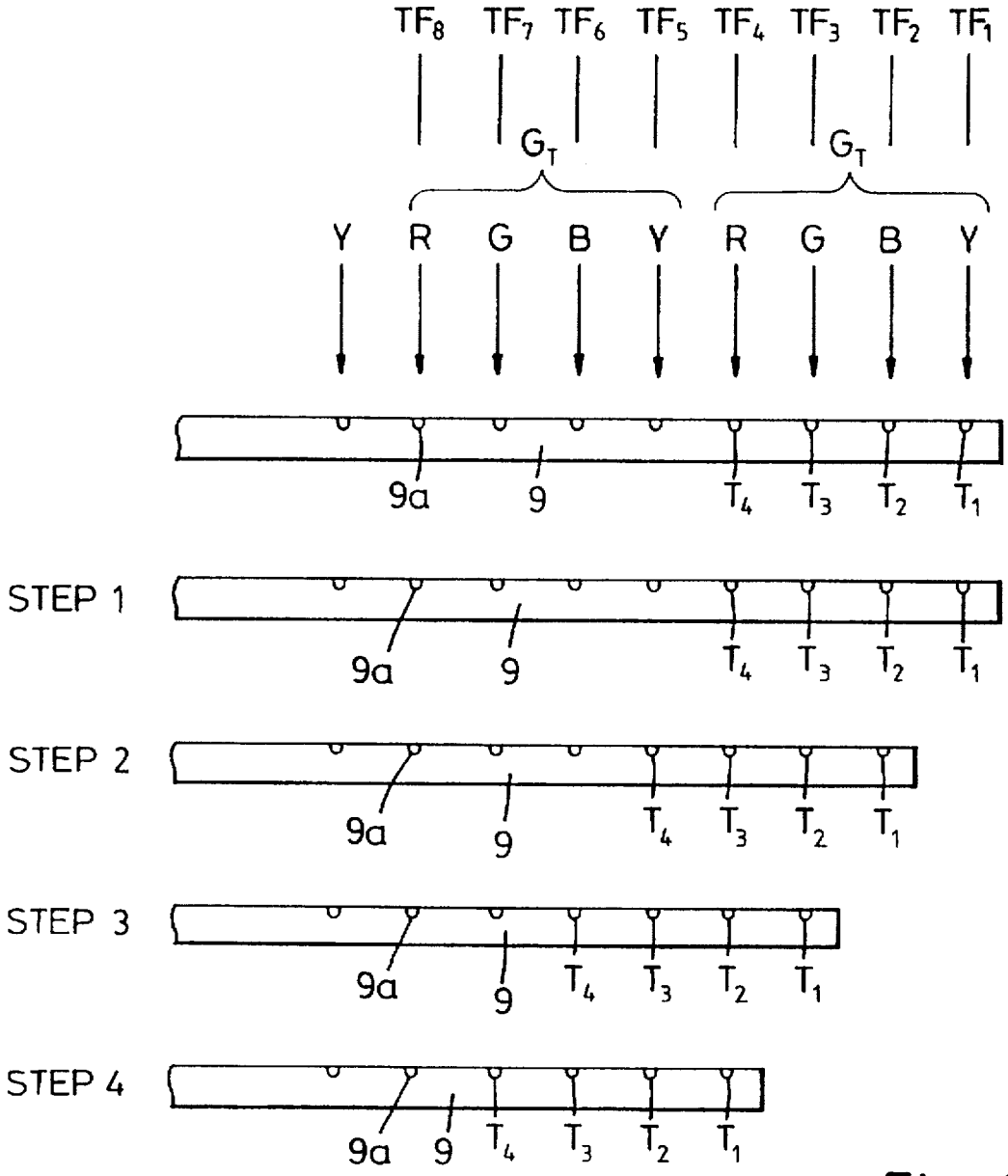
FIG. 2 is a diagrammatic illustration of the tuft loading process.

By way of example, the tuft loading process will be described in relation to a pattern wherein 3 tufts of yarns Y are loaded into sites 9a at locations $T_1$, $T_2$, $T_4$ and yarn R is loaded into site 9a at location $T_3$ (FIG. 2).

At step 1 of the loading process, carrier 9 remains at the first loading position (FIG. 1) and the control means 60 operates the tuft forming means 50 to load tufts. Site at $T_1$ requiring yarn Y is in registry with tuft forming means at position $TF_1$ and so is selected to deposit a tuft into site at $T_1$. None of the other sites $T_2$, $T_3$, $T_4$ are in registry with a tuft forming means 50 having the correct yarn and so the tuft forming means at locations $TF_2$–$TF_8$ are not selected and remain inoperative.

At step 2, the carrier 9 is moved by the drive means 70 by one site spacing to the left as viewed in FIG. 2. Site $T_4$ is now in registry with the tuft forming means at $TF_5$ to receive yarn Y therefrom and site $T_3$ is in registry with the tuft forming means at $TF_4$ to receive yarn R therefrom. Accordingly, the control means 60 selects tuft forming means at $TF_4$ and $TF_5$ to deposit tufts and maintain the tuft forming means at the remaining locations inoperative.

At step 3 the carrier 9 is again moved by one site spacing to the left by the drive means. However, for this step, none of the sites 9a are in registry with a tuft forming means for depositing the correct yarn and so none of the tuft forming means at locations $TF_1$ to $TF_8$ are selected by the control means.

At step 4, the carrier 9 is again moved by one site spacing to the left. Site $T_2$ is now in registry with the tuft forming means at $TF_5$. Accordingly the tuft forming means at $TF_5$ is selected to deposit yarn Y into site $T_2$ while the tuft forming means at the remaining sites are not selected.

The sites $T_1$ to $T_4$ are now all loaded with tufts in the correct sequence.

To complete the loading process, the carrier 9 is now returned to the first position (FIG. 1).

While the above example is described in relation to the loading of 4 sites, $T_1$–$T_4$, it will be appreciated that loading of all sites 9a on the carrier 9 will have been completed during steps 1 to 4 by the selection of the appropriate tuft forming means 50 along the path of travel during each loading step.

In the example referred to in the introduction, ie. a 4 yard wide loom having 7 tufts per inch, it is necessary to provide 1008 tufts for each row. Using a conventional yarn carrier to supply 4 different colors to each tuft position requires 4032 (ie. 4×1008) yarn end supplies to be provided on the creel.

In the example described in FIG. 1, for the same width of carpet at 7 tufts per inch only 1008 yarn end supplies need to be provided on the creel.

In the example of FIG. 1, the number of different yarns making up a sequence and defining groups G is four. It will be appreciated that the number of different yarns in each group may be greater or less than four. In order to accommodate a number of yarns different to four, then the number of loading positions for the carrier will be changed accordingly.

Also in the above example, the number of tuft forming means 50 is chosen to be the same as the number of sites 9a. It will be appreciated that the number of tuft forming means 50 may be smaller than the number of sites 9a by a multiple dependent upon the number of tuft forming means 50 in a group $G_T$. Loading of tufts into the carrier would follow the same process as described above except that the carrier would need to be moved by a greater distance along the path of travel.

In a particular example, it is envisaged that the tuft carrier 9 contains an excess number of sites 9a corresponding to the number of steps in the sequence required to fill the tuft carrier for loading of the grippers. In the example described in FIGS. 1 and 2, the excess number of sites 9a would equate to four sites.

This has the advantage of enabling the loading sequence for the carrier to terminate at step 4 in FIG. 2. Once the carrier 9 has been emptied by the grippers, the loading sequence may then begin in reverse order to that shown in FIG. 2.

In the above example, a single yarn is supplied to each tuft yarn forming means 50. It is envisaged that a group of yarns may be supplied to each position, wherein the group of yarns supplied to one tuft forming means 50 is different to the group of yarns supplied to the neighbouring tuft forming means 50.

Accordingly, for the example described in FIG. 1, 4 different groups of yarns may be supplied at positions TF1, $TF_2$, $TF_3$, $TF_4$ (and then repeated $TF_5$ to $TF_8$, etc).

If each different group of yarn contains say, 6 different colors, the choice of colors available for selection would be 6×4, ie. 28. Thus, at each loading step, the control means 60 would operate a selected tuft forming means 50 in two stages, viz. first select the required color from its group and second operate the tuft forming means to form a tuft from the selected yarn.

The above system of feeding different groups of yarns to each neighbouring tuft forming means 50 enables an Axminster gripper loom to weave selecting from a large number of different colored yarns which previously has only been possible on a spool Axminster loom.

In FIGS. 4 to 7 there is illustrated a loom 80 including a tuft loading apparatus 90 according to a first embodiment of the present invention.

The tuft carrier 9 is located in a guide 19 in order to guide its longitudinal movement along the path of travel previously mentioned. The carrier 9 includes a toothed rack 31 which meshes With a pinion gear (not shown) driven by the drive means 70.

The apparatus 90 is located directly above the main grippers 1 of the loom 80 such that when the carrier 9 is at its first position, the grippers 1 are able to rise and grip the full row of tufts 17 held by the carrier 9.

Once the carrier 9 has been emptied of tufts 17 by the grippers 1, the tuft loading process begins in readiness to provide a fully loaded carrier by the time the grippers 1 rise again.

Figure 5:
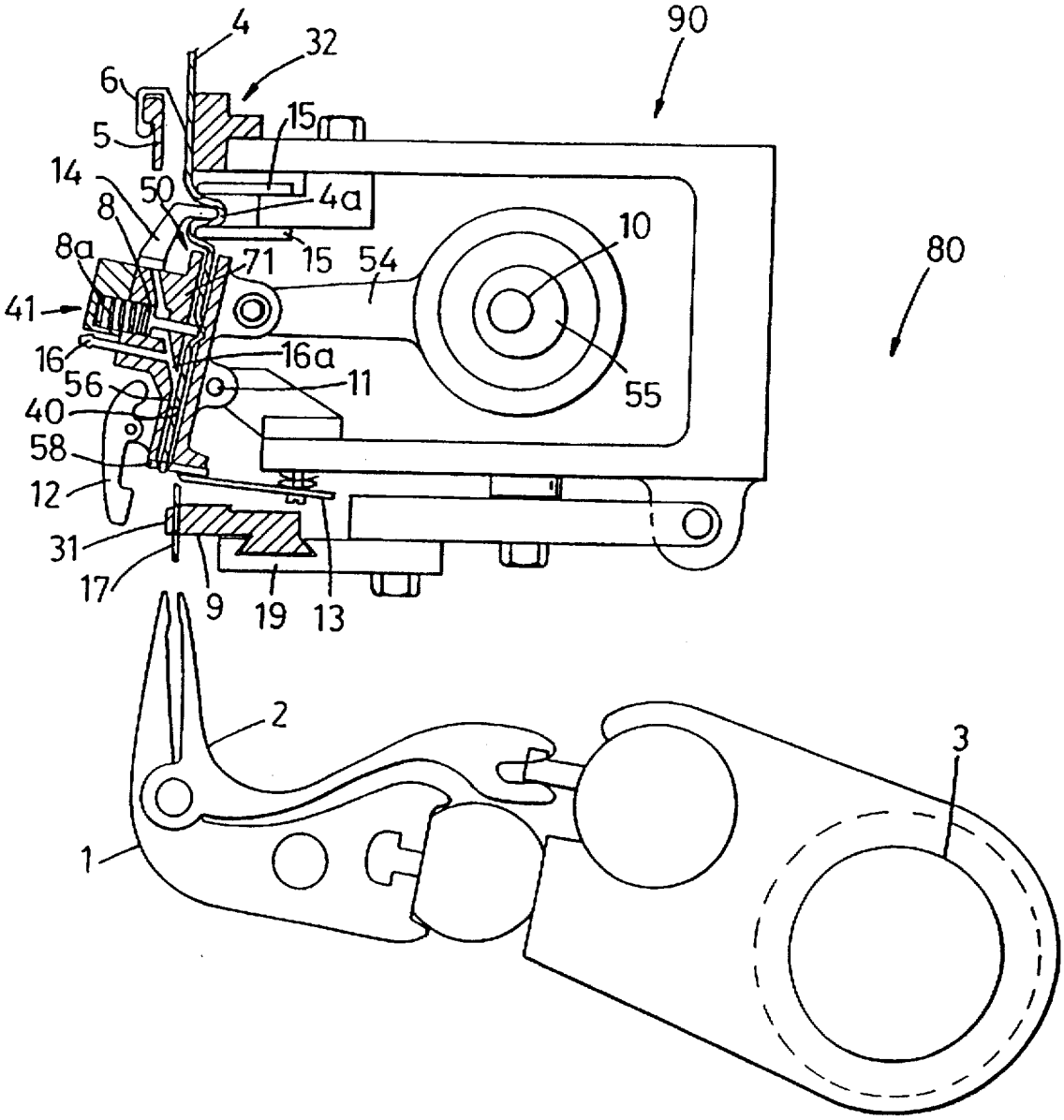
FIG. 5 is a view similar to FIG. 4 showing the apparatus in a different mode during the tuft forming process.

Each tuft forming means 50 includes a body 71 which is pivotally mounted at 11 on the loom frame for reciprocal movement between a tuft feed position (FIG. 4) and a tuft loop forming position (FIG. 5). The body 71 is continuously reciprocated between the feed and loop forming positions by a connection rod 54 driven by an eccentric 55 on a drive shaft 10. The drive shaft 10 is driven by the main shaft of the loom 80 and so is in synchronism with the motion of the grippers 1.

Yarn 4 is supplied to each tuft forming means via a yarn feed 32 and extends from the yarn feed 32 along a passageway 40 in which is located a yarn trap 41 in the form of a fluid operated plunger 8 biased by a spring 8a to a yarn gripping position.

A yarn trap 6 is located at the yarn feed 32 so as to enable yarn to be drawn from the feed under tension and held in position once the tension, has been removed.

The body 71 carries a yarn loop forming finger 14 which is arranged to engage the yarn 4 extending between the yarn feed 32 and yarn trap 41 each time that the body 71 moves to the loop forming position.

As seen in FIG. 5 a loop 4a is formed by the finger 14 pushing yarn 4 between a pair of spaced static fingers 15.

The length of the yarn 4 drawn from feed 32 (and hence the length of the eventual tuft) is determined by the relative displacement of finger 14 and fingers 15 and this may be adjusted by either mounting fingers 15 on the loom frame and/or mounting finger 14 on body 71 such that their position is adjustable.

The plunger 8 normally grips yarn 4 in the passageway 40 and so the loop 4a is formed during reciprocation of the body 71 by drawing yarn from the yarn feed 32. This creates slack yarn between the yarn feed 32 and trap 41 in readiness for feeding to the carrier 9. If the tuft forming means 50 is selected to create a tuft, the trap 41 is activated to release the yarn 4 by applying high pressure air via conduit 16; the high pressure fluid also being directed along passageway 40 via conduit 16a. Activation of the trap 41 preferably occurs as the body 71 swings forwardly away from fingers 15.

Accordingly the slack yarn is drawn into the passageway 40 as the fingers 14, 15 move apart.

At this stage the yarn 4 is projecting from the bottom of the body 71 and as the top half of the main body 71 reaches the extent of its travel, the bottom part of the main body 71 is moving backwards carrying the yarn into the slots of the tuft carrier. As the yarn enters the slot of the tuft carrier a set of narrow presser fingers 12 push the yarn into the slots and as they do so, the yarn is cut by the scissor action of the blade 13 and the bottom of the passageway 40 containing the yarn. A hardened plate 58 is mounted to the bottom of the main body 71 and the yarn passes through holes in this plate which form the other side of the scissor. The fingers 12 are designed to make contact with the yarn just before the yarn is cut and so the tuft 17 is held in place as it is cut from the yarn source. Each finger 12 is spring loaded (not shown) and pivoted so that the correct amount of force can be applied to the tuft.

Conveniently body 71 of each tuft forming means 50 comprises a unitary block 56 in which a plurality of side by side passages 40 are formed.

Figure 6:
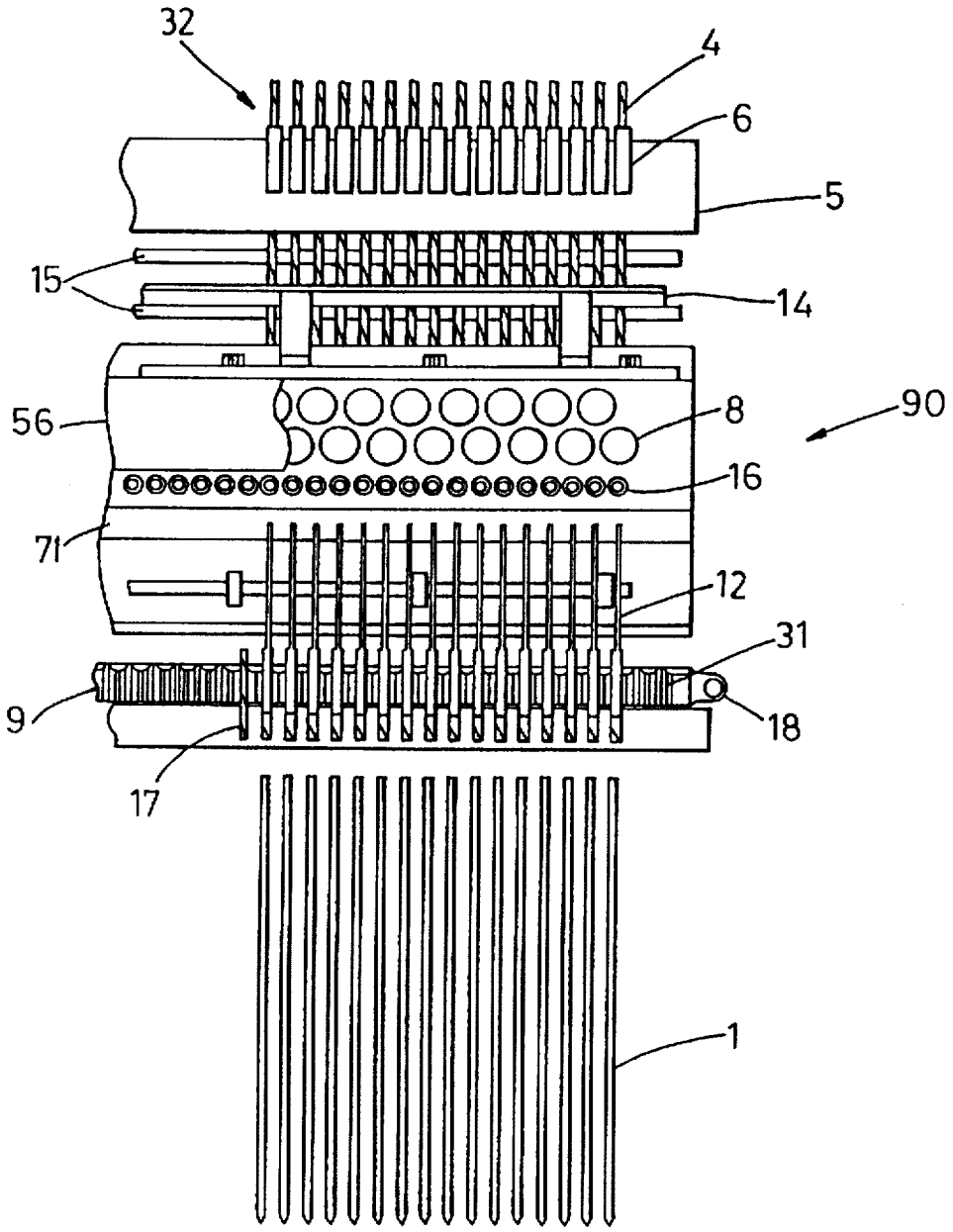
FIG. 6 is a front view of the loom as shown in FIG. 4.

As seen in FIG. 6 the plunger 8 of adjacent tuft forming means 50 are staggered in order to enable the tuft forming means 50 to be closely spaced.

Figure 8:
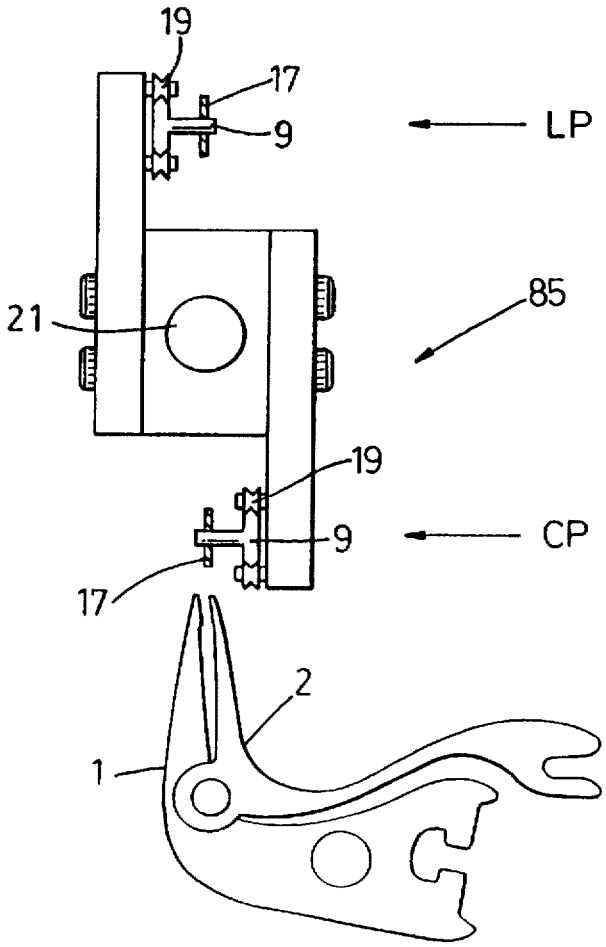
FIG. 8 is a part side view similar to FIG. 4 showing a second modified tuft carrier system according to the present invention.

As described above, a single tuft carrier 9 is located beneath the tuft forming means 50 and holds the tufts 17 in readiness for collection by the grippers 1. It is envisaged that a tuft carrier transfer mechanism may be included in order to remove a loaded carrier 9 from the tuft forming means 52 to present it to a remote collection position whereat the tufts are collected by the grippers. Such an arrangement creates a buffer system where pre-loaded carriers 9 are stored for transfer to the collection position. Such a buffer system may have many sets of tuft carriers or it could consist of as few as two sets. A transfer mechanism 85 in FIG. 8 which includes two sets of carriers 9. Each carrier 9 is mounted on a rotatable shaft 21 in respective guides 19. The shaft 21 is rotatable between two fixed positions so as to successively move each carrier to a loading position LP and a collection position CP. The carrier at the collection position CP presents the tufts 17 to the main grippers, while the other carrier 9 at the loading position LP allows the tuft carrier to be extracted and a loaded one installed or to be loaded in-situ. However the removal and replacement of a tuft carrier would be sequential operations hence reducing the time available for loading. This problem would not arise if the tuft carrier was fixed and hence not removed from the rotating mechanism 85; the loading apparatus would then need to traverse this fixed tuft carrier to place the tufts 17.

A triple position rotating mechanism 85 would allow simultaneous extraction of an empty tuft carrier and replacement of a loaded one. A four position mechanism 85 may have a redundant position but could present the loading and collection positions in a more convenient orientation.

Where it is possible to operate the loading apparatus faster than the rate of use of yarn, the creation of a buffer of filled tuft carriers is possible. In this case a failure in the operation of the loading device does not require the immediate cessation of the loom. Due to the nature of the material used as pile yarns, failure to grip and select the yarn can occur for a number of reasons. This can be remedied by manual intervention and a buffer store could supply the loom while the corrective action is taken.

An alternative type of tuft carrier could take the form of a flexible belt system. It may be possible to form a specially profiled, double-sided toothed belt that could be driven by the teeth on the inner surface and hold tufts in specially profiled slots on the outer surface.

Figure 7:
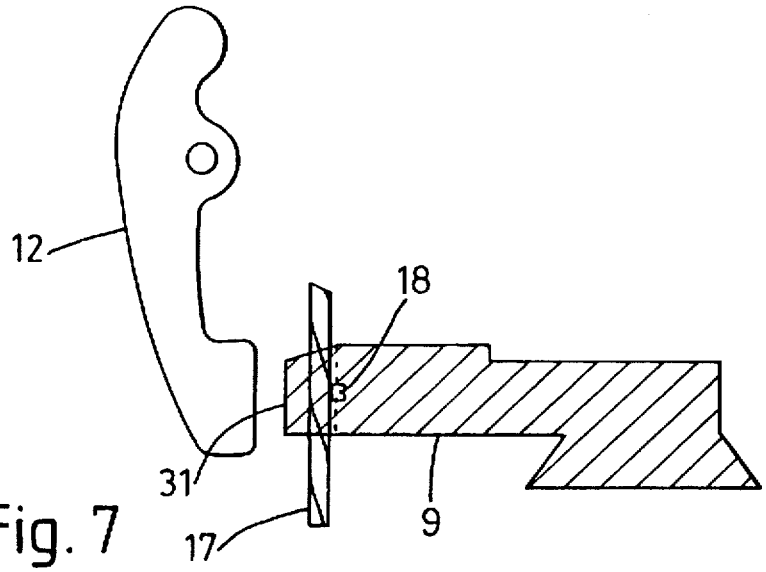
FIG. 7 is an enlarged part view of the tuft carrier as seen in FIG. 4.

Another aspect of the present invention relates to the detection of failure to form a tuft. In the case of a conventional loom, this occurs for a variety of reasons, many relating to the performance of the yarn itself. Irregularities or knots in the yarn or a restriction in the yarn supply can cause failure of the yarn to be selected and the ability to detect this failure is beneficial for the reduction of faults in the carpet. The apparatus according to the present invention may include a device to detect the failure of the tuft formation operation. As shown in FIG. 7, a tuft carrier 9 can be manufactured from an electrically insulating material and the bottom of each tuft slot can be fitted with an electrical contact 18. When the electronically conductive finger or pusher 12 presses the tuft 17 into the tuft carrier slot, the tuft prevents a contact being made between the two components. However, the absence of a piece of yarn will allow a contact to be made and this can be detected by a control circuit. In addition, it is possible to check that the main grippers have removed every tuft by cycling the filling process once without selecting any tuft forming means, immediately after the set of tufts has been removed. If the pushers or contacts in the tuft carrier are individually sensed, each contact should be made if every tuft has been removed. A control circuit connected to each pusher or contact can then determine where a tuft has been left by failing to detect a connection between the two parts at the appropriate part in the loom cycle. This system allows the automatic checking for failure to create tufts and failure of the main grippers to select the tufts.

Figure 9:
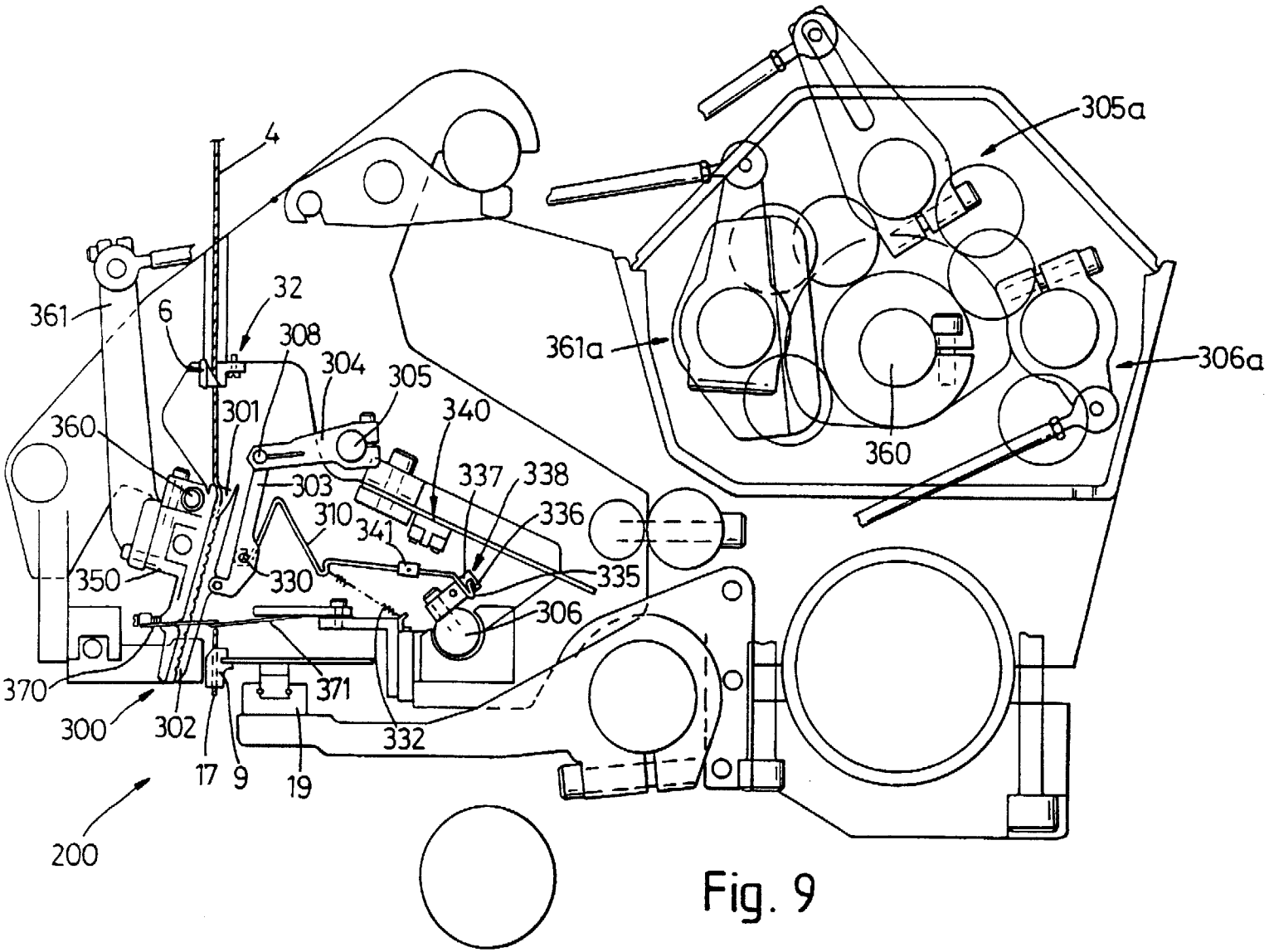
FIG. 9 is a part side view of a loom including a tuft forming apparatus according to a second embodiment of the present invention.

A second embodiment 200 for forming tufts 17 is illustrated in FIG. 9.

Figure 10:
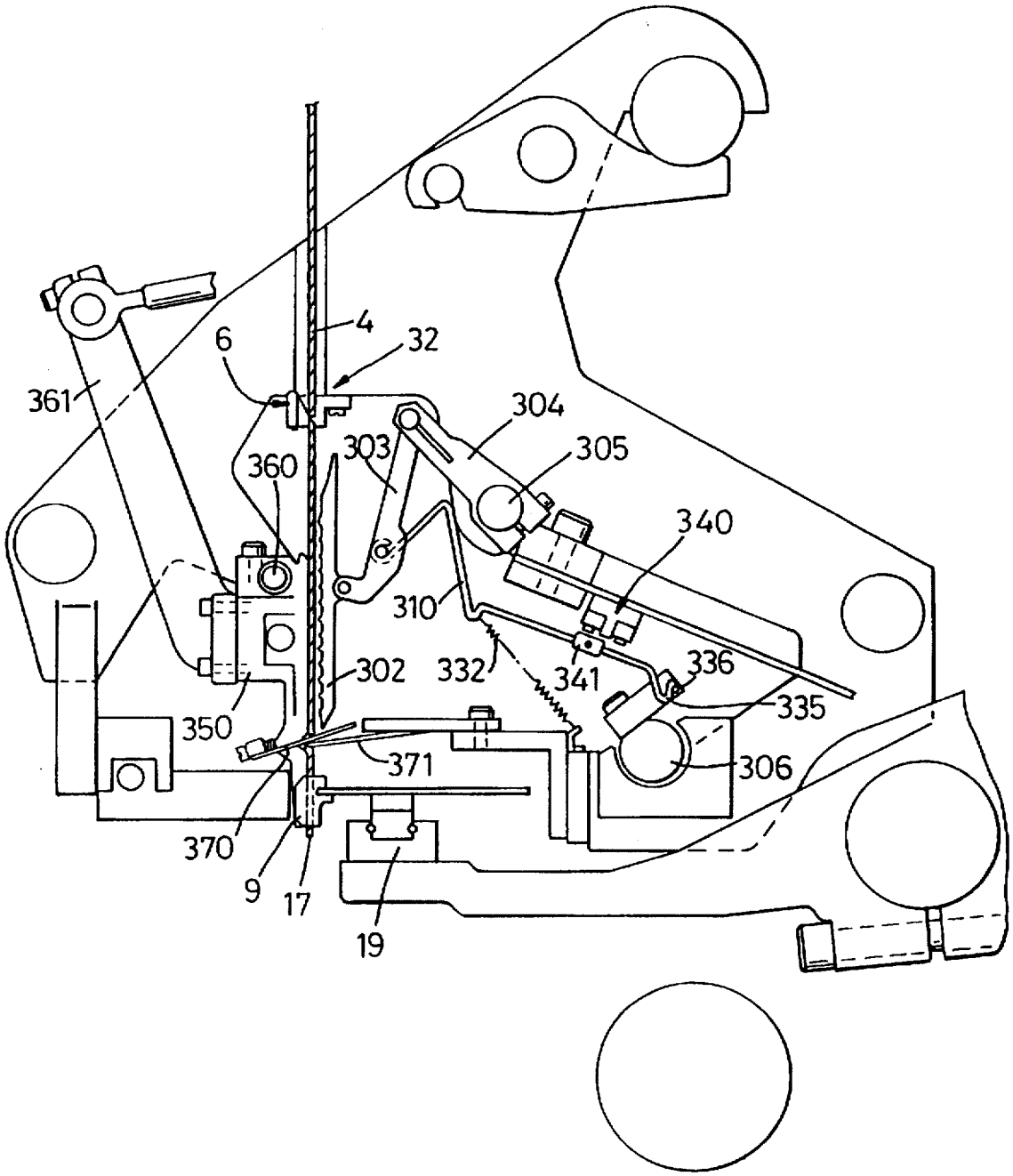
FIG. 10 is a view similar to FIG. 9 showing the tuft forming apparatus in a different operational position.

In the second embodiment, a series of individual mechanical grippers 300 are utilised for drawing each tuft forming yarn 4 from the yarn feed 32. In FIGS. 9 and 10 only a single gripper 300 is shown.

The gripper 300 includes a yarn guide in the form of a channel 301 along which a gripping claw 302 continuously reciprocates.

The claw 302 is mounted on a connecting lever 303 which is driven by a drive arm 304 extending from a reciprocating drive shaft 305. The drive shaft 305 is reciprocated by a conjugate cam 305*a* which co-operates with a main drive shaft 360.

The lever 303 is pivotally attached to the drive arm 304 by a pivotal connection 308. The lever 303 is also pivotally connected to a reciprocating shaft 306 via a connecting link 310. The shaft 306 is reciprocated by a conjugate cam 306*a*.

The link 310 is connected at one end to lever 303 via a pivotal connection 330 and is biased in a direction away from channel 301 by resilient means preferably in the form of a spring 332. The opposite end of link 310 includes a latch formation 335, preferably in the form of a hook, for selective engagement with a latch 336, in the form of a peg, mounted within a slot 337 formed in an arm 338 projecting from the shaft 306.

The connecting link 310 is operable to move the claw 302 toward the base of the channel 301 and thereby enable it to grip yarn 4 located in the channel 301 and draw it from the yarn feed 32 during its downward stroke or to move the claw 302 away from the base of the channel 301 and thereby space the claw 302 sufficiently away from the base of the channel to prevent it drawing yarn from the yarn feed 32 during its downward stroke.

Control of the position of claw 302 by link 310 is achieved as follows. Spring 332 normally biases the link 310 and thus claw 302 away from the base of channel 310. Accordingly provided that latches 335 and 336 are not engaged, the claw 302 will be spaced from the base of channel 301 and will not engage yarn 4.

Movement of the claw 302 toward the base of the channel 301 is achieved by engagement of latches 335, 336 and advancement of arm 338 toward channel 301.

Engagement of latchesd 335, 336 is achieved by lifting of arm 304 which raises link 310 to the position shown in FIG. 10. Each link 310 is provided with an anvil 341 which is magnetically attractable to an electromagnet 340. If the electromagnet 340 is energised, the link 3 10 is retained at its uppermost position as the shaft 306 moves arm 338 forward toward the channel 301 and accordingly latches 335 and 336 are engaged to push the link 310 forward also.

The link 310 is resiliently deformable to accommodate forward movement of the arm 338 and to also resiliently urge the claw 302 into engagement with the yarn 4. Preferably the link 310 is formed from a resilient wire.

If tuft formation is not required, then the electromagnet 340 is not energised. Accordingly, when arm 304 lowers, the link 310 is also lowered and this is timed to occur before arm 338 moves forward. Accordingly, latch 335 drops below latch 336 and is not engaged so that continual forward movement of arm 338 has no effect on link 310.

The channel 301 is formed in a block 350 which is pivotally mounted on the machine frame via a pivotal connection 360. The block 350 is reciprocated by arm 361 which in turn is reciprocated by a conjugate cam 361*a*. The block 350 pivots outwardly to a tuft feed position as shown in FIG. 9 while the claw 302 moved downwardly to draw yarn 4. The block then pivots inwardly as shown in FIG. 10 to push drawn yarn into the tuft carrier 9 and sever the yarn 4 to form tuft 17 by means of a cutting blade 370 mounted on the block 350 co-operating with a static blade 371.

It is envisaged that the tuft loading apparatus according to the present invention may be located to one side of the loom instead of being located directly above the grippers 1. Each carrier 9 would then be loaded with a row of tufts and thereafter the carrier would be inserted sideways into the path of the secondary set of main grippers.

The tuft carrier can take the form of a single unit holding a complete row of tufts or be divided into narrower sections. In the case of a four yard wide loom, if the tuft carrier was one yard wide, the complete filling device would not need to be much greater than that width. The exact layout of the arrangement can take several forms depending on the priorities of simplification, space requirements, size of a creel, access to the back of the loom etc.

Where the loading apparatus is to the side of the loom, the filled tuft carrier can be transported sideways into a rotating selector or other form of buffer storage system. The empty tuft carrier can be refilled during the extraction or replacement process so that its transverse movement facilitates the sequential filling of sections of the tuft carrier as it passes the loading apparatus. Whether the tuft carrier needs to be released from the rotating selector immediately after use or it can be extracted from the selector in stages during the filling process would depend on the ratio of the filling time to the transporting time.

It is also envisaged that the tuft carrier may be filled behind the weaving position, with either the tuft carrier or loading apparatus traversing the appropriate amount. Using this method, it is also possible to fill all tuft sites in the tuft carrier, section by section. In the case of a four yard wide tuft carrier, loaded in four sections, after the first section was loaded, the loading apparatus or the tuft carrier would traverse by one yarn to allow the adjacent section to be loaded. Alternatively, every fourth yarn location can be filled simultaneously and the loading device or the tuft carrier moved transversely by one tuft location between loading operations. This method distributes the yarn ends over the width of the tuft carrier so that the lateral movement is very much reduced. It also allows the intermediate positions to be filled with additional yarn carriers, removing the advantage of a smaller creel but allowing many colors to be achieved. Typically a twelve color yarn carrier allows a maximum of twelve different colors to be incorporated into the carpet. Four adjacent twelve color yarn carriers could contain forty-eight different colors permitting the production of carpet more typical of Spool Gripper looms. Whether the tuft carrier moves one yarn end at a time or by a larger section, the tuft carrier can carry out the required lateral movement by means of guides on the rotating selector or by removal from the selector, using another guiding mechanism.

We claim:

1. Loading apparatus to load individual tufts into an elongate tuft carrier having tuft retention sites spaced along its length, the apparatus including:

guide means for guiding the tuft carrier along a path of travel, a series of individually selectively operable tuft forming means spaced along said path of travel, each tuft forming means being operable when selected to feed an individual tuft to a tuft retention site on said carrier, drive means drivingly connected to the carrier for moving the carrier along said path of travel, the drive means being operable to intermittently move the carrier through a series of successive positions where predefined tuft retention sites are moved temporarily into registry with each tuft forming means, and control means for controlling selective operation of the series of tuft forming means, the control means being operable to actuate selected tuft forming means to feed tufts to those sites in registry with the selected tuft forming means while the carrier is located at each successive position.

2. Apparatus according to claim 1 including supply means for each individual tuft forming means for supplying each tuft forming means with a tuft yarn having a characteristic different from the tuft yarn supplied to an adjacent tuft forming means in said series.

3. Apparatus according to claim 2 wherein said supply means are arranged in a predefined sequence, so that the tuft yarns are supplied to said series of tuft forming means in said predefined sequence, said sequence being repeated along said path of travel.

4. Apparatus according to claim 1, wherein each tuft forming means includes a tuft yarn feed adapted to receive tuft yarn from a tuft yarn source, selectively operable yarn drawing means for drawing a predetermined length of tuft yarn from said tuft yarn feed to form a tuft forming yarn portion, and severing means for severing the tuft forming yarn portion from the remainder of the yarn to thereby form a tuft.

5. Apparatus according to claim 4 wherein the yarn drawing means includes selectively operable reciprocating yarn gripping means having forward and backward strokes, said gripping means, on selection, gripping the tuft yarn during one of its strokes in order to draw yarn from said yarn feed.

6. Apparatus according to claim 5 wherein said reciprocating yarn gripping means includes a reciprocally mounted yarn engaging claw which is continuously reciprocated, the claw being movably mounted between a selected position where it engages yarn during said one stroke of reciprocation and a non-selected position where it does not engage yarn during said one stroke.

7. Apparatus according to claim 5 wherein the yarn gripping means includes a reciprocally mounted body including a yarn passageway containing a selectively operable yarn trap for movement between a yarn release position and a yarn trap position, the body further including a yarn engaging member located between the yarn trap and the yarn feed, the yarn engaging member engaging the yarn extending between the yarn feed and trap during reciprocation of the body to form a loop of yarn by drawing yarn from said yarn feed when the trap is at its yarn trap position, and fluid means for drawing yarn along said passageway in a direction away from the yarn feed when the selectively operable yarn trap has been moved to its yarn release position.

8. Apparatus comprising in combination a weaving loom having means for inserting individual tufts into a fabric, an elongated tuft carrier with a series of tuft-retention sites, guide means for guiding the tuft carrier along a path of travel, a series of individually selectively operable tuft forming means spaced along said path of travel, each tuft forming means being operable when selected to feed an individual tuft to a tuft retention site on said carrier, drive means drivingly connected to the carrier for moving the carrier along said path of travel, the drive means being operable to intermittently move the carrier through a series of successive positions where predefined tuft retention sites are moved temporarily into registry with each tuft forming means, and then to a position in registry with said tuft-inserting means, control means for controlling selective operation of the series of tuft forming means, the control means being operable to actuate selected tuft forming means to feed tufts to those sites in registry with the selected tuft forming means while the carrier is located at each successive position.

9. Apparatus according to claim 8 wherein the loom is an Axminster gripper loom, said means for inserting tufts into a fabric comprising grippers adapted to register with said tuft-retention sites of said carrier, said loom having means to operate said grippers to remove the individual tufts from said carrier and insert the removed tufts into a fabric.

10. A method of loading an elongate tuft carrier with tufts, comprising the steps of providing the elongate tuft carrier having a series of tuft retention sites spaced along its length, effecting longitudinal movement of the tuft carrier along a path of travel, arranging a plurality of individually selectively operable tuft forming means in spaced relationship along said path of travel so as to register with said series of tuft retention sites, driving the tuft carrier intermittently through a series of successive positions so that predefined tuft retention sites are moved into temporary registry with each tuft forming means and selectively operating at least one of said tuft forming means to feed a tuft into a site presented thereto while the carrier is located at each successive position.

11. A method according to claim 10 further including the steps of providing an Axminster loom having grippers adapted to register with tuft-retention sites of said tuft carrier, operating said loom through a sequence of picks, for each pick of the loom, loading said tuft carrier with tufts and presenting said loaded tufts to the grippers of the loom.

* * * * *